US005488343A

United States Patent [19]

Taddei

[11] Patent Number: 5,488,343

[45] Date of Patent: Jan. 30, 1996

[54] HIGH-TENSION CURRENT TRANSFORMER, WITH STORAGE PRODUCTION BY MEANS OF THE AUTOMATIZATION OF THE INSULATION THEREOF

[76] Inventor: Mario A. Taddei, via Paolo Frisi, 24, Rome, Italy, 00197

[21] Appl. No.: 140,117

[22] PCT Filed: Apr. 14, 1992

[86] PCT No.: PCT/IT92/00041

§ 371 Date: Nov. 2, 1993

§ 102(e) Date: Nov. 2, 1993

[87] PCT Pub. No.: WO93/18529

PCT Pub. Date: Sep. 16, 1993

[30] Foreign Application Priority Data

Mar. 4, 1992 [IT] Italy ..... RM92A0143

[51] Int. Cl.[6] ..... H01F 27/28; H01F 15/04

[52] U.S. Cl. ..... 336/229; 336/84 C

[58] Field of Search ..... 336/84 C, 229

[56] References Cited

U.S. PATENT DOCUMENTS 4,731,599 3/1988 Preissinger ..... 336/84 C

FOREIGN PATENT DOCUMENTS 2112489 10/1971 Germany .
2524549 12/1976 Germany .
347414 4/1931 United Kingdom .
548394 10/1942 United Kingdom .

*Primary Examiner*—Leo P. Picard
*Assistant Examiner*—L. Thomas
*Attorney, Agent, or Firm*—Beveridge, DeGrandi, Weilacher & Young

[57] ABSTRACT

A high-tension current transformer having two or three type of insulating units with one coil, the transformer being provided for storing and for being assembled in a short time, to prevent the need for performing the insulation and the production of transformers on order.

16 Claims, 3 Drawing Sheets

HIGH-TENSION CURRENT TRANSFORMER, WITH STORAGE PRODUCTION BY MEANS OF THE AUTOMATIZATION OF THE INSULATION THEREOF

BACKGROUND

1. The Field of the Invention

The present invention concerns a high-tension current transformer, with storage production, by means of automatization of its insulation which, independently form the variable feature of the specific request, solves the two following problems that at present have not yet been solved by the prior art:

1) the automatization of the insulation of the high-tension current transformers;

2) the possibility of producing, for the storage, the insulation of the high-tension current transformers, changing the actual productive cycles that impose to prepare the insulation of the current transformers time by time and by request, on the base of the variable features of the specific request.

2. The Prior Art

The aim of the present invention is to solve the following two main difficulties A and B that are usually met in the realization of transformers for high and very high tension current:

A) Except for cases of primary high currents, the primary as well as the secondary windings of the high-tension current transformers are always of the kind wound according to the need of reaching the Amperecoils so as to obtain, with not overdimensioned cores sections, the efficiency and the precision classes requested for measuring.

With the primary or secondary winding wound on the core, the difficulty of the insulation thereof is met in the meeting point between the insulation of the winding part, wound on the core, and the outlet insulation, i.e. in the insulation of what is currently called the neck of the insulation parcel.

Due to this difficulty, the insulation of the parcel's insulation neck requests the intervention of specialized handicraft with consequent time and efficiency losses, while it is possible to automatize, by means of special ribbon-applying machines, the insulation of the part of the wound winding and the insulation of the straight outlet part. This means, that the automatization of the insulation is only apparent.

[The enclosed FIG. 1 shows a vertical section of two different placements of the transformers, with the core respectively provided in the lower and in the upper part.

On the left side of the figure the disposition is shown with the primary wound winding in A.T. on which the insulation is transferred, while the core with the secondary winding in B.T. is provided in the lower part of the transformer.

The meaning of the symbols is the following:

c =neck of the insulation parcel i =insulation

A.T. =high tension

B.T. =low tension

On the right side of the figure the disposition is shown wherein the insulation is provided above the core and the secondary would winding in B.T., as the two are provided in the upper part of the transformer with the same symbols as above.

It shall be noted that with above mentioned two dispositions the insulation is performed for the whole nominal tension of the current transformer.]

B) The many variables provided in the realization of current transformers:

nominal primary and simple currents, and double and triple transformation relationships;

nominal secondary currents of 5 Amp and also 1 Amp;

number of the secondary cores from 1 to 3 for the different measuring and protection requirements;

efficiency and precision class of the secondary cores force the producer to provide each time the whole production cycle of which the insulation is the most important part, on request, on the basis of the specific requirements of the specific client, and do not allow a production provided on the basis of storage production.

In consideration of this all, it should be underlined that:

the most important problem in the realization of the current transformers consists in the performing of the insulation between the primary winding in A.T. and the secondary winding in B.T., a project based on the maximum saving in the cost of materials is not always convenient, in consideration of the different technical and commercial purposes of an industry with respect to a project based on a higher cost of the materials but that allows the maximum automatization and the possibility of performing a storage production—instead than an order production—with an evident increase in efficiency.

BRIEF SUMMARY AND OBJECTS OF THE INVENTION

The present invention completely solves the problems described at points A and B.

The invention according to one embodiment is a transformer having a primary core with a primary winding wrapped on the primary core, a secondary core with a second winding wrapped on the secondary core, and an insulated connection winding electrically connecting the primary winding with the secondary winding. With this embodiment, the insulated connection winding has a U-shaped upper portion where the primary core is located, and a U-shaped lower portion where the secondary core is located.

Yet another embodiment of the invention is a transformer component having first core with core windings wrapped thereon and an insulated, U-shaped connection winding electrically connected to the first core windings for electrically connecting the first core windings to second core windings.

DETAILED DESCRIPTION OF A PREFERRED EMBODIMENT OF THE INVENTION

The enclosed FIG. 1 shows a vertical section of two different placements of the transformers, with the core respectively provided in the lower and in the upper part.

Figure 1A:
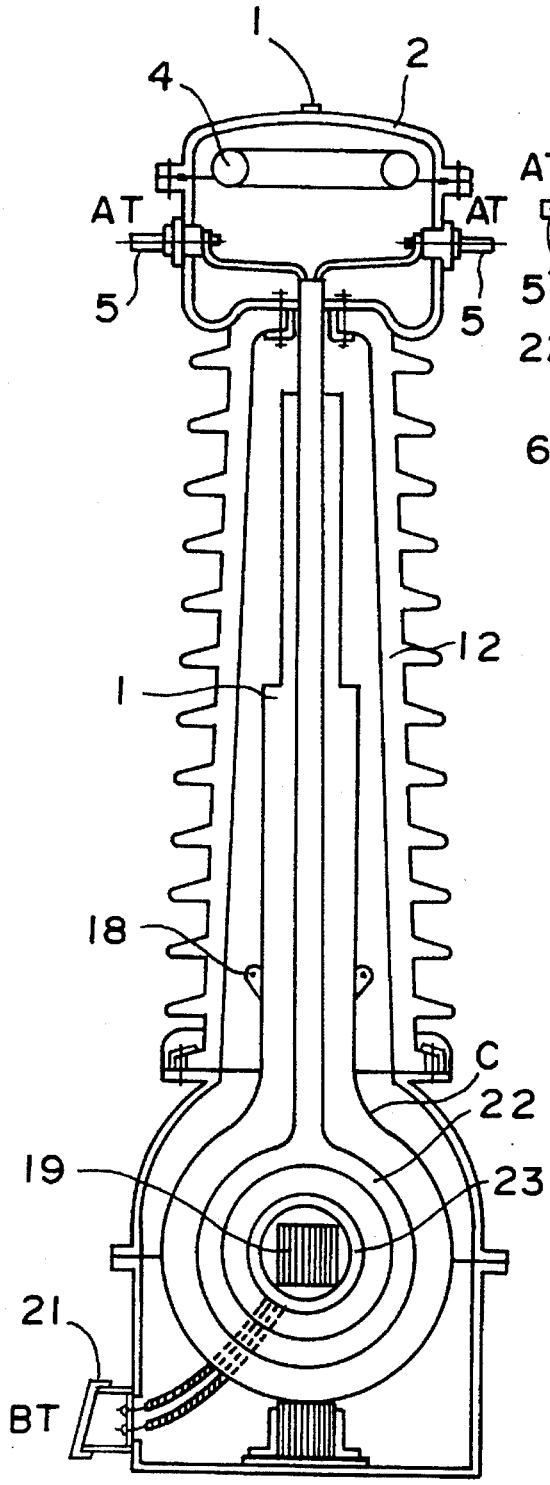
FIGS. 1A and 1B illustrate two embodiments of conventional transformers.

In FIG. 1A, the disposition is shown with the primary wound winding in A.T. on which the insulation is transferred, while the core with the secondary winding in B.T. is provided in the lower part of the transformer.

The meaning of the symbols is the following:

c =neck of the insulation parcel i =insulation

A.T. =high tension

B.T. =low tension

Figure 1B:
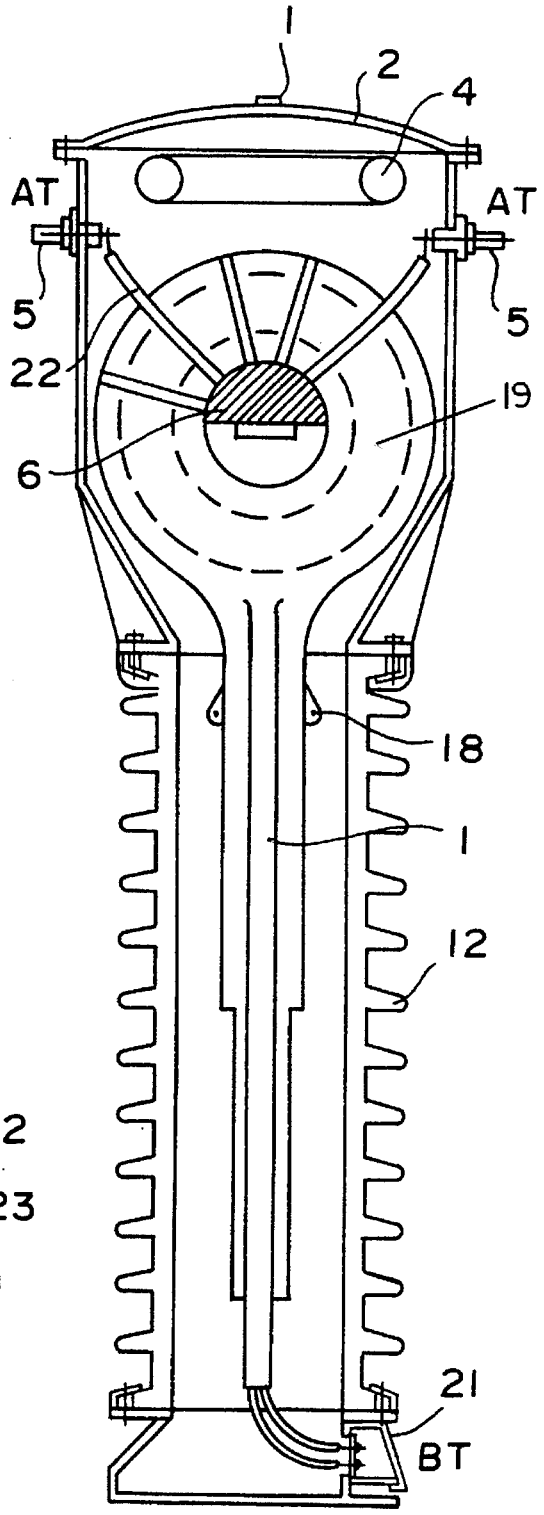

In FIG. 1B, the disposition is shown wherein the insulation is provided above the core and the secondary would winding in B.T., as the two are provided in the upper part of the transformer with the same symbols as above.

It shall be noted that with the above mentioned two dispositions the insulation is performed for the whole nominal tension of the current transformer.

Figure 2:
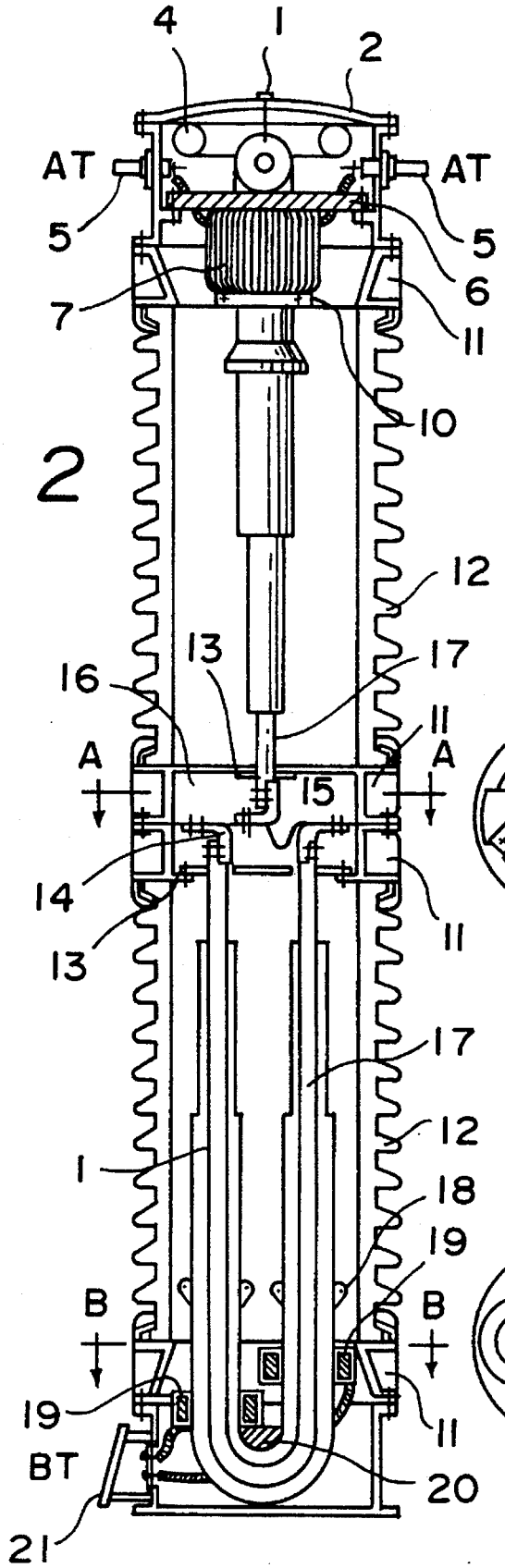
FIG. 2 illustrates a cross sectional view front view of a transformer according to an embodiment of the invention.
Figure 2A:
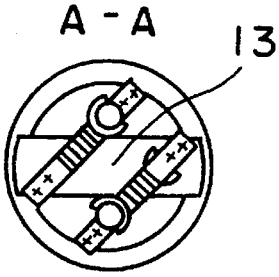
FIGS. 2A and 2B illustrate a cross sectional view taken along section lines A—A and B—B, respectively, in FIG. 2.
Figure 2B:
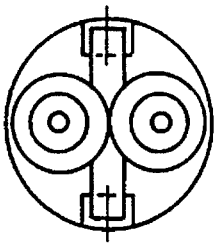

FIG. 2, FIG. 2A and FIG. 2B show a vertical section and two horizontal sections, respectively, of the transformer according to the present invention.

Figure 3:
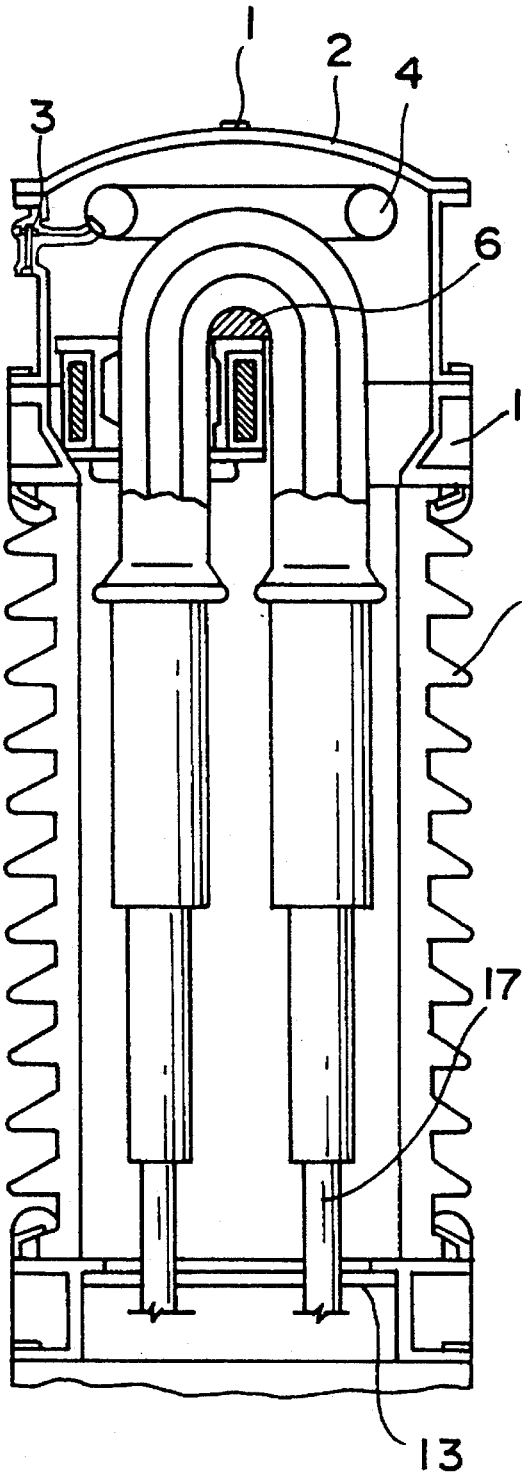
FIG. 3 illustrates a partial cross sectional side view of a transformer according to an embodiment of the invention.
Figure 3B:
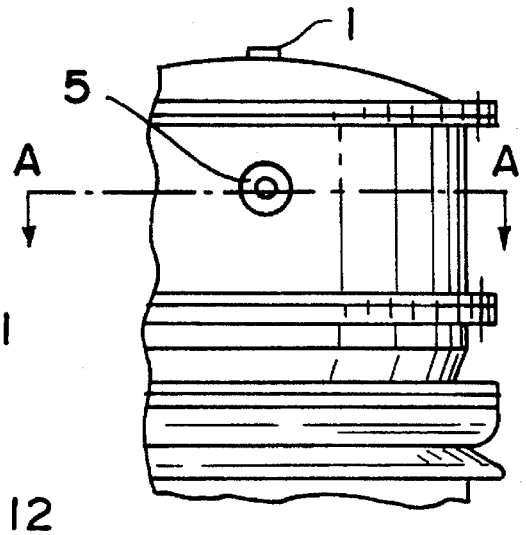
FIG. 3B illustrates a cross sectional view taken along section line A—A in FIG. 3B.
Figure 3A:
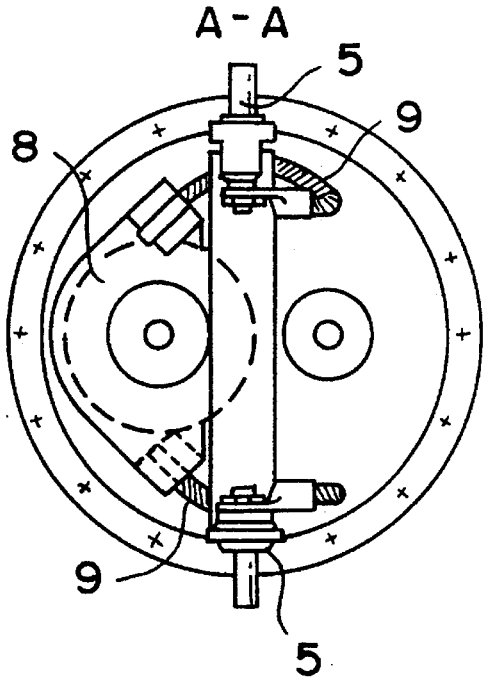
FIG. 3A illustrates an external view of the upper side of the embodiment shown in FIG. 3.

FIG. 3, FIG. 3A, and FIG. 3B show a vertical section, an external view of the upper side and a horizontal section, respectively, in the case of primary high currents.

Relating now to the details of the figures, they show:

a cap 1 for the oil-filling a cover 2 a breather 3 an elastic membrane 4 a primary clamp 5 an insulating support section 6 a primary core 7 an aluminum melting 8 carrying the primary current an aluminum rope 9 for high primary currents a support ring 10 out of insulating material a metal ring 11 a porcelain 12 an insulating tissue 13 an end clamp 14 with a 90° - plate connection a flexible blade 15 connection a coupling room 16 a copper tube 17 an insulated diffusor ring 18 a secondary core 19 a centering insulating section 20 a series of clamps 21 for the secondary windings a primary winding 22 a secondary winding 23.

That is, FIG. 1A, FIG. 1B, FIG. 2, FIG. 2A, and FIG. 2B illustrate a transformer with a porcelain body 12. The porcelain body 12 has a cover 2 with a cap 1, for filling the transformer with oil. An elastic membrane 4 is provided in the porcelain body 12 which compensates for volume fluctuations of the oil due to thermal changes.

The transformer has a primary core 7 which rests on a support ring 10 formed out of insulating materials. The primary core 7 is wrapped with primary winding 22. The transformer also has a pair of secondary cores 19, each of the secondary cores being wrapped with a secondary winding 23. The primary winding is electrically connected to an aluminum melt 8 for carrying the primary current, which in turn is electrically connected to the aluminum rope 9 for carrying high primary currents. As can be seen from FIG. 3A, the aluminum rope 9 is connected to primary clamp 5.

The primary winding 22 also is electrically connected to the secondary windings by an insulated connection winding formed of two copper tubes 17. As can be seen in FIG. 3, the insulated connection winding has an upper U-shaped portion formed of a copper tube 17 which passes through the primary core 7 and which rests on insulating support section 6. The insulated connection winding also has a lower U-shaped portion formed of another copper tube 17 which passes through the secondary cores 19, and which is positioned under a centering insulating section 20.

The copper tubes 17 of the two U-shaped portions are connected in a coupling room 16. Each end of the copper tubes are provided with end clamps 14 having a 90° plate connection. The plates of the lower U-shaped portion are then connected to the plates of the upper U-shaped portion by flexible blade connections 15.

In addition to those components described above, the transformer illustrated in FIG. 2, FIG. 2A, FIG. 2B, FIG. 3, FIG. 3A, and FIG. 3B also includes a series of clamps 21 for the secondary windings, a metal ring 11 around the coupling room 16, an insulating tissue 13, and an insulated diffusor ring 18. The features provided by this embodiment of the invention will now be discussed.

The realization problems, deriving from the many variables mentioned in B) are to be separated from the main insulating problem mentioned in A) that is completely transferred and solved on a winding that connects in the shape of a ring the following cores:

the first tension core provided in the upper part of the current transformer, onto which the primary winding of A.T. is directly wound;

the group of secondary cores provided in the lower part of the current transformer onto which the secondary B.T. windings are directly wound;

for eliminating the neck of the insulating parcel and the following insulating thereof, the connection winding is provided for high current intensity so as to allow, with one single coil, to thermically bring the determined ampere-values from the maximum ampere-coils available to the primary winding.

Once the neck of the insulating parcel has been eliminated, the insulation of the connection winding may be performed in continuity by automatic ribbon-applying machines.

The already existing copper tubes having a diameter of 50 mm to 60 mm and with maximum currents of 1,600 to 2,000 Amp, should satisfy all electric conduction requests and supply the most valid support for the automatic ribbon application, from the electric point of view (minimum electric gradients in the paper due to the absence of edges and wedges), as well as from the mechanical point of view (the ribbon application takes place with a constant tension in the winding paper).

The insulation of the connection winding is provided for half the nominal tension of the current transformer. Therefore, it is easy to understand that by bringing four insulation units on standard levels and storing them, for a nominal tension of 75 kV, 110 kV, 190 kV and 400 kV, and providing the coupling of two equal units, placed one towards the other, current transformers for nominal tensions of 150 kV, 220 kV, 380 kV and 800 kV or other normalized tensions may be quickly prepared.

The completing of the realization of the active part of said transformers is now reduced to the placing, before the coupling of the insulation units, in following succession:

the upper core 7 with the primary winding directly wound and the lower cores 19 with the relative secondary windings directly wound;

the diffusor rings 18 fixed at the ends of the metal nets wound above the insulation, so as to limit the electric field of the insulation units: the force lines of the electric fields end on above mentioned nets that therefore get identified with the two extreme reinforcements of the series of two equal condensers.

For the correct coupling of the two units, the ends of the tubes should be provided with end clamps with a 90°—plate connection, and it should be requested to unite the plates of the lower tubes with the plates of the upper tubes with flexible blade connections (see FIG. 2A).

The present invention has the following features:

the transformer is of the sealed kind and completely filled up with oil. The volume variations of the oil due to the thermic excursions are balanced by an elastic membrane of known kind having one surface at contact with the oil and the other one at contact with the air. Thus the forming of condensing inside the transformer may be prevented.

Both the upper and the lower cores are of the toroidal wound kind and, due to the lack of air gaps, the magnetic reluctance and the magnetizing current—that is the main components in the determination of the measuring errors of the transformer—are reduced to the minimum.

The excellent magnetic binding of the windings makes the dispersion flows minimum, and practically brings to nul the dispersion reactance.

The primary winding, directly wound on the core in the upper part of the transformer, has a length less than the one in other realizations and therefore, as a principle, it behaves better than the primary winding of other realizations towards the short circuit currents. Furthermore, the saturation of the upper core reduces the short circuit currents on the connection ring within well bearable limits under the thermic and dynamic aspect.

The equality of the two condensers put in series assures an equal division of the tension between the two insulation units.

I claim:

1. A transformer comprising:

a primary core with a primary winding wrapped thereon;

at least one secondary core with a secondary winding wrapped thereon; and an insulated connection winding for electrically connecting the primary winding with the secondary winding, the connection winding having an upper U-shaped portion and a lower U-shaped portion, the primary core being located at the upper U-shaped portion and the at least one secondary core being located at the lower U-shaped portion of the connection winding.

2. The transformer of claim 1, wherein the connection winding is formed of a copper tube.

3. The transformer of claim 2, wherein the copper tube has a diameter in the range of 50 mm to 60 mm.

4. The transformer of claim 1, wherein the connection winding is capable of carrying currents in the range of 1,600 A to 2,000 A.

5. The transformer of claim 1, wherein the upper U-shaped portion of the connection winding is detachably engaged with the lower U-shaped portion of the connection winding.

6. The transformer of claim 5, wherein a nominal voltage provided by the primary core on the upper U-shaped portion of the connection winding is equal to a nominal voltage provided by the at least one secondary core on the lower U-shaped portion of the connection winding.

7. The transformer of claim 5, wherein the upper U-shaped portion of the connection winding is detachably engaged to the lower U-shaped portion of the connection winding through end clamps, the end claims positioning the upper U-shaped portion of the connection winding at a 90° angle with respect to the lower U-shaped portion thereof.

8. The transformer of claim 1, wherein the ring-shaped connection winding passes through the primary core and the at least one secondary core.

9. The transformer of claim 1, wherein the connection winding is insulated with ribbon-applied insulation.

10. A transformer component comprising:

a first core having first core windings wrapped thereon; and an insulated U-shaped connection winding electrically connected to the first core windings, for electrically connecting the first core to second core windings.

11. The transformer component of claim 10, wherein the U-shaped connection winding passes through the first core.

12. The transformer component of claim 10, wherein the U-shaped connection winding is electrically connectable to another, separate connection winding with a core having second current windings wrapped thereon, so as to form a single transformer.

13. The transformer component of claim 10, wherein the U-shaped connection winding is formed of a copper tube.

14. The transformer component of claim 13, wherein the copper tube has a diameter in the range of 50 mm to 60 mm.

15. The transformer of claim 10, wherein the U-shaped connection winding is capable of carrying currents in the range of 1,600 A to 2,000 A.

16. The transformer of claim 10, wherein the connection winding is insulated with ribbon-applied insulation.

* * * * *